US005715506A

United States Patent [19]

Takeuchi et al.

[11] Patent Number: 5,715,506

[45] Date of Patent: Feb. 3, 1998

[54] IMAGE FORMING APPARATUS COMPRISING A MECHANISM FOR POSITIONING A ROTATABLE MEMBER AND A TRANSFER DRUM

[75] Inventors: Akihiko Takeuchi, Yokohama; Toshihiko Ochiai, Tokyo; Motoi Kato, Yokohama; Toshiaki Miyashiro, Ichikawa; Akira Ito, Tokyo; Nobuaki Kabeya, Toride; Takao Kume; Takehiko Suzuki, both of Yokohama, all of Japan

[73] Assignee: Canon Kabushiki Kaisha, Tokyo, Japan

[21] Appl. No.: 412,120

[22] Filed: Mar. 28, 1995

[30] Foreign Application Priority Data

Mar. 30, 1994 [JP] Japan ..... 6-083857

[51] Int. Cl.[6] ..... G03G 15/00; G03G 15/16

[52] U.S. Cl. ..... 399/303; 399/313

[58] Field of Search ..... 399/303, 304, 399/313, 66

[56] References Cited

U.S. PATENT DOCUMENTS

| | | | |
|---|---|---|---|
| 4,072,412 | 2/1978 | Suda et al. | 399/304 |
| 4,914,737 | 4/1990 | Amemiya et al. | 399/303 |
| 5,016,056 | 5/1991 | Johnson et al. | 399/304 |
| 5,084,736 | 1/1992 | Suzuki et al. | 399/303 |
| 5,153,654 | 10/1992 | Yuminamochi et al. | 399/318 |
| 5,196,885 | 3/1993 | Takeuchi et al. | 399/168 |
| 5,214,480 | 5/1993 | Aoki et al. | 399/314 |
| 5,250,994 | 10/1993 | Ito et al. | 399/303 X |
| 5,287,163 | 2/1994 | Miyashiro et al. | 399/66 |
| 5,390,012 | 2/1995 | Miyashiro et al. | 399/303 |
| 5,406,358 | 4/1995 | Kimura et al. | 399/304 |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

An image forming apparatus has a recording medium bearing member bearing a recording medium thereon and rotatable, the recording medium bearing member having in the surface thereof a recess extending in the direction of the rotary shaft thereof, image formation being effected on the recording medium born on the recording medium bearing member, and a rotatable member abutted against the recording medium bearing member, the rotatable member being provided with a abutting portion abutted against the recording medium bearing member, and a regulating portion adapted to abut against the recording medium bearing member when the recess and the rotatable member become opposed to each other. Thus, the distance between the recess and the bearing portion, is regulated the rotatable member being movable between a first position in which the abutting portion abuts against the recording medium bearing member and a second position in which the regulating portion abuts against the recording medium bearing member. The regulating portion is spaced apart from the recording medium bearing member when the abutting portion is abutted against the recording medium bearing member.

28 Claims, 6 Drawing Sheets

IMAGE FORMING APPARATUS COMPRISING A MECHANISM FOR POSITIONING A ROTATABLE MEMBER AND A TRANSFER DRUM

BACKGROUND OF THE INVENTION

1. Field of the Invention

This invention relates to an image forming apparatus which is provided with a recording medium bearing member carrying a recording medium thereon and rotated and which effects image formation on the recording medium born on the recording medium bearing member, and particularly to an image forming apparatus in which for example, a plurality of colors of toner images are successively formed on a photosensitive member and these toner images are superposedly transferred to a transfer medium born on a transfer drum to thereby obtain a color image.

2. Related Background Art

Use has been made of image forming apparatuses in which a plurality of colors of toner images are successively formed on a photosensitive drum and these toner images are superposedly transferred to a transfer medium born on a transfer drum to thereby obtain a color image.

Also, as the transfer drum, there has been proposed one as shown in FIG. 8 of the accompanying drawings wherein an electrically conductive elastic layer 2*b* and a dielectric material layer 2*c* are provided on a core metal 2*a* serving also as a transfer electrode. On this transfer drum 2, there are a gripper for gripping the leading end portion of a transfer medium, a support member for supporting the gripper, etc. It is therefore necessary that a rotatable member adapted to bear against the transfer drum such as an adsorbing roller or a charge removing roller bear against the transfer drum while avoiding this portion and be released therefrom.

For that purpose, the adsorbing roller and the charge removing roller can bear against the transfer drum after they have passed the gripper and be released immediately before the gripper comes to them, but to ensure the adsorbing roller, etc. to bear against the transfer drum and be released therefrom, a suitable amount of stroke (the order of 5–10 mm) becomes necessary and further, when the responsiveness of a pressing mechanism such as the adsorbing roller by a plunger is also taken into account, it is impossible to effect the control of subtle bearing and release such as aiming at the leading end of the transfer medium gripped by the gripper.

Also, as shown in FIG. 8, rollers 15 are provided on the opposite ends of the adsorbing roller 8 and those rollers 15 are pressed in the direction of arrows A so as to normally bear against the flange 16 of the transfer drum 2, whereby when a recess in which the gripper of the transfer drum 2 is provided has come to a position facing the adsorbing roller 8, it is conceivable to suppress the movement of the adsorbing roller 8 toward the transfer drum 2 by the rollers 15, and provide a state in which the adsorbing roller 8 and the recess are spaced apart from each other. This also holds true of the charge removing roller 9.

However, to accomplish good adsorption and charge removal, it is necessary to cause the adsorbing roller 8 and charge removing roller to thereby bear against the transfer drum while keeping the amounts of deformation of the electrically conductive layer 2*b* and the adsorbing roller 8 and charge removing roller sufficient. For that purpose, the rollers 15 are caused to bear against the flange 16 with sufficient pressure so that the rollers 15 may always bear against the flange 16, that is, the distance between the shafts of the adsorbing roller 8 or the charge removing roller and the transfer drum 2 may always be constant. Accordingly, it is conceivable that the bearing pressure of the adsorbing roller 8 and charge removing roller against the transfer drum 2 is varied by the irregularity of the outer diameters of the transfer drum 2 and the adsorbing roller 8 and charge removing roller. On the other hand, the transfer drum 2 bears against the photosensitive drum 3 with subtle balance and therefore, when the bearing pressure of the adsorbing roller 8 and charge removing roller against the transfer drum 2 is varied, the balance of the bearing of the transfer drum 2 against the photosensitive drum 3 will get out of order or the bearing position thereof will be strained, and this will immediately result in an unsatisfactory quality of image such as color shift or misregistration.

SUMMARY OF THE INVENTION

It is an object of the present invention to provide an image forming apparatus which can well effect image formation on a recording medium born on a rotatable recording medium bearing member.

It is a further object of the present invention to provide an image forming apparatus provided with a rotatable member movable toward and away from a recording medium without affecting the image formation on the recording medium.

It is still a further object of the present invention to quickly space the recess of a recording medium bearing member and a rotatable member apart from each other when said recess and said rotatable member become opposed to each other.

Further objects and features of the present invention will become apparent from the following detailed description when read in conjunction with the accompanying drawings.

DESCRIPTION OF THE PREFERRED EMBODIMENTS

Figure 7:
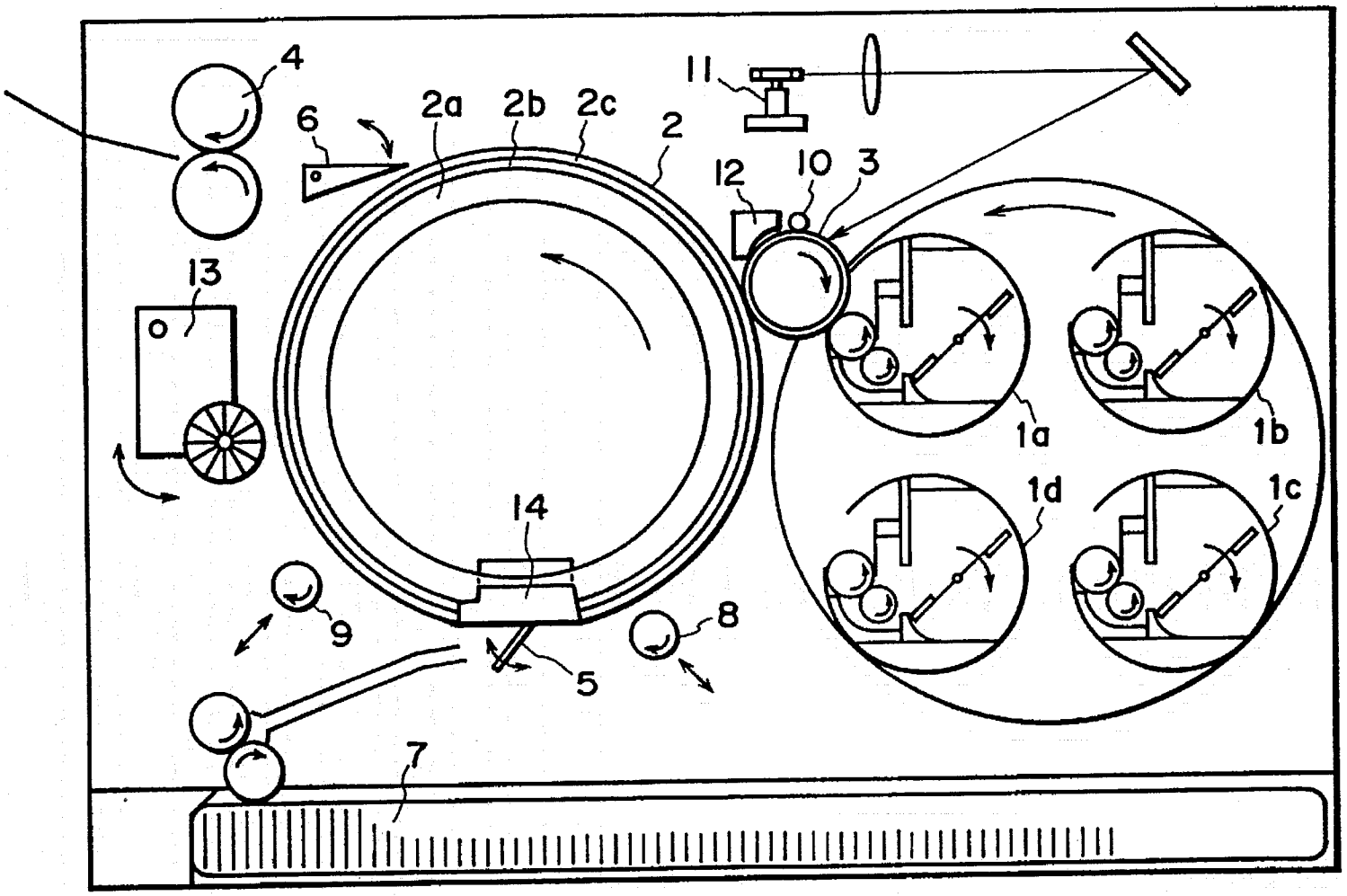
FIG. 7 schematically shows the construction of an image forming apparatus to which the present invention is applicable.

FIG. 7 shows an image forming apparatus of the electrophotographic type according to an embodiment of the present invention.

In FIG. 7, an electrophotographic photosensitive drum 3 which is an electrostatic latent image bearing member is rotated in the direction of arrow and the surface thereof is uniformly charged by charging means 10, whereafter an optical image is applied thereto by a laser exposure device 11 or the like and the surface of the photosensitive drum 3 is exposed, whereby an electrostatic latent image is formed on the photosensitive drum 3. This latent image is developed by a developing device containing a color developer therein, for example, a developing device 1*a*, 1*b*, 1*c* or 1*d* containing yellow, magenta, cyan or black color developer therein and is visualized as a toner image, whereby a toner image of each color is formed on the photosensitive drum 3.

On the other hand, a transfer medium 7 is supplied to a transfer drum 2 which is, for example, in the form of a drum, and the leading end thereof is gripped and fixed by grippers 5 which are gripping members provided on the surface of the transfer drum 2, and further the transfer medium 7 is electrostatically adsorbed by an adsorbing roller 8 and is held and born on the transfer drum 2. The transfer medium 7 born on the transfer drum 2 is repetitively conveyed by the rotation of the transfer drum 2 toward a transfer station in which the photosensitive drum 3 and the transfer drum 2 abut against each other in opposed relationship with each other. The transfer drum comprises a metallic cylinder (core metal) 2*a* serving also as a transfer electrode, an electrically conductive elastic material layer 2*b* fitted over the core metal 2*a*, and a dielectric material layer 2*c* covering the elastic material layer 2*b*. The gripper 5 is provided in a recess formed by cutting away a portion of the elastic material layer 2*b* and dielectric material layer 2*c* of the transfer drum 2, with the tip end thereof protruded. The toner images of respective colors formed on the photosensitive drum 3 are successively superposed one upon another and transferred onto the transfer medium carried on the transfer drum 2 in the transfer station, by a transfer voltage applied to the metallic cylinder 2*a*.

The image formation will further be described. An electrostatic latent image of a first color is firstly formed on the photosensitive drum 3 by the exposure of an optical image based on an image signal of a first color, e.g. yellow, this latent image is developed by the developing device 1*a* containing the yellow developer therein to thereby form a yellow toner image on the photosensitive drum 3, and the yellow toner image is transferred onto the transfer medium carried on the transfer drum 2. Subsequently, any residual toner on the photosensitive drum 3 is removed by a cleaner 12, whereafter an electrostatic latent image of a second color is formed on the photosensitive drum 3 by exposure based on an image signal of a second color, e.g. magenta, and the electrostatic latent image is developed by the developing device 1*b* containing the magenta developer therein to thereby form a magenta toner image, which is then superposed and transferred onto the transfer medium on the transfer drum 2 onto which the yellow toner image has already been transferred. Prior to the transfer of this toner image of the second color, the adsorbing roller 8 is released from the transfer drum 2 and this state is continued until the next transfer medium is born.

Subsequently, a process similar to that described above is repeated for each of a third color and a fourth color, e.g. cyan and black, whereby a color image comprising the toner images of four colors, i.e., yellow, magenta, cyan and black, superposed one upon another is formed on the transfer medium 7 on the transfer drum 2. Thereafter, the transfer medium 7 is separated from the transfer drum 2 by a separating device (separating pawl) 6 and is sent to a fixating device 4, where the mixing of the toner images of the respective colors and the fixing thereof to the transfer medium 7 are effected by fixation to thereby make them into a permanent image of full color, whereafter the transfer medium is discharged out of the image forming apparatus. The transfer drum after the separation of the transfer medium 7 therefrom has any toner adhering to its surface removed by a transfer drum cleaner 13 and has any charge thereon removed by a charge removing roller 9 and is electrically initialized.

Figure 1:
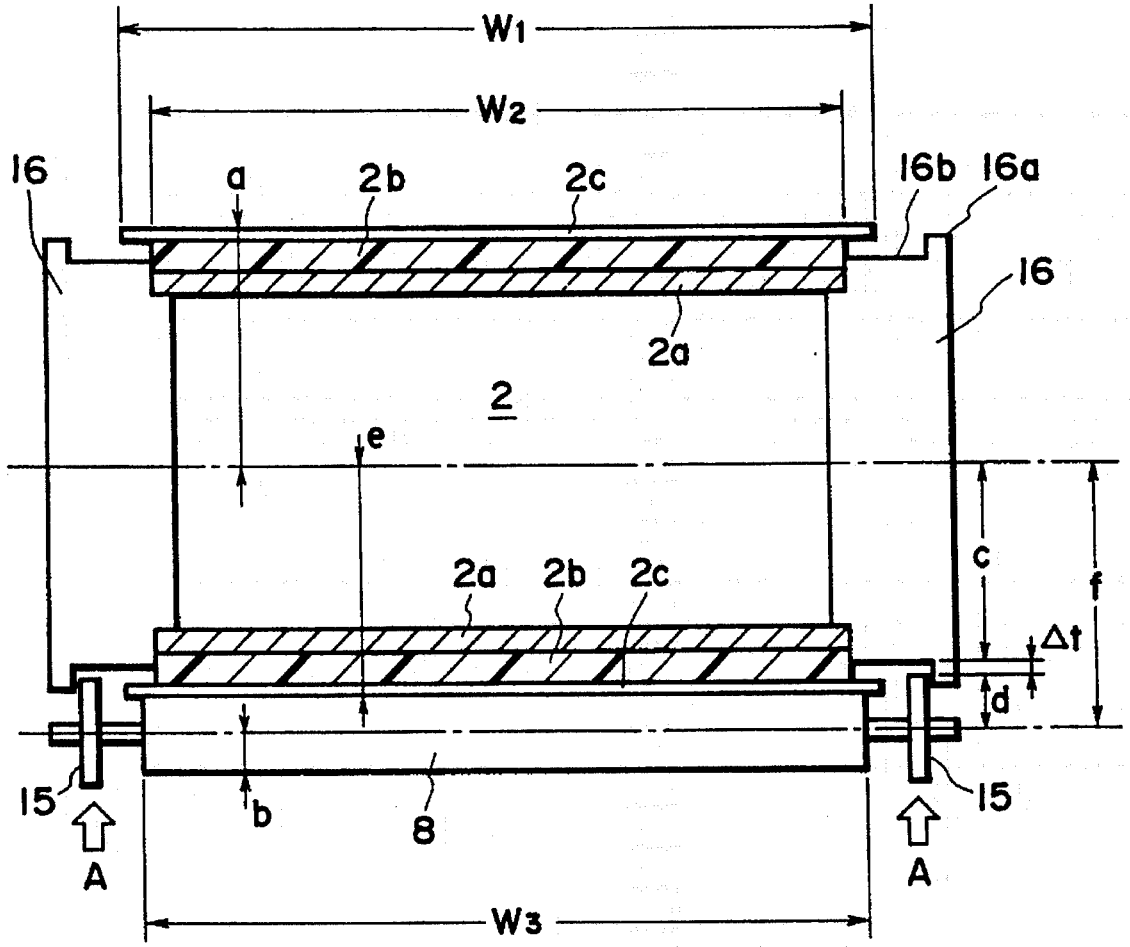
FIG. 1 is a cross-sectional view showing a transfer drum and an adsorbing roller in an embodiment of the present invention when they are abutted each other.
Figure 8:
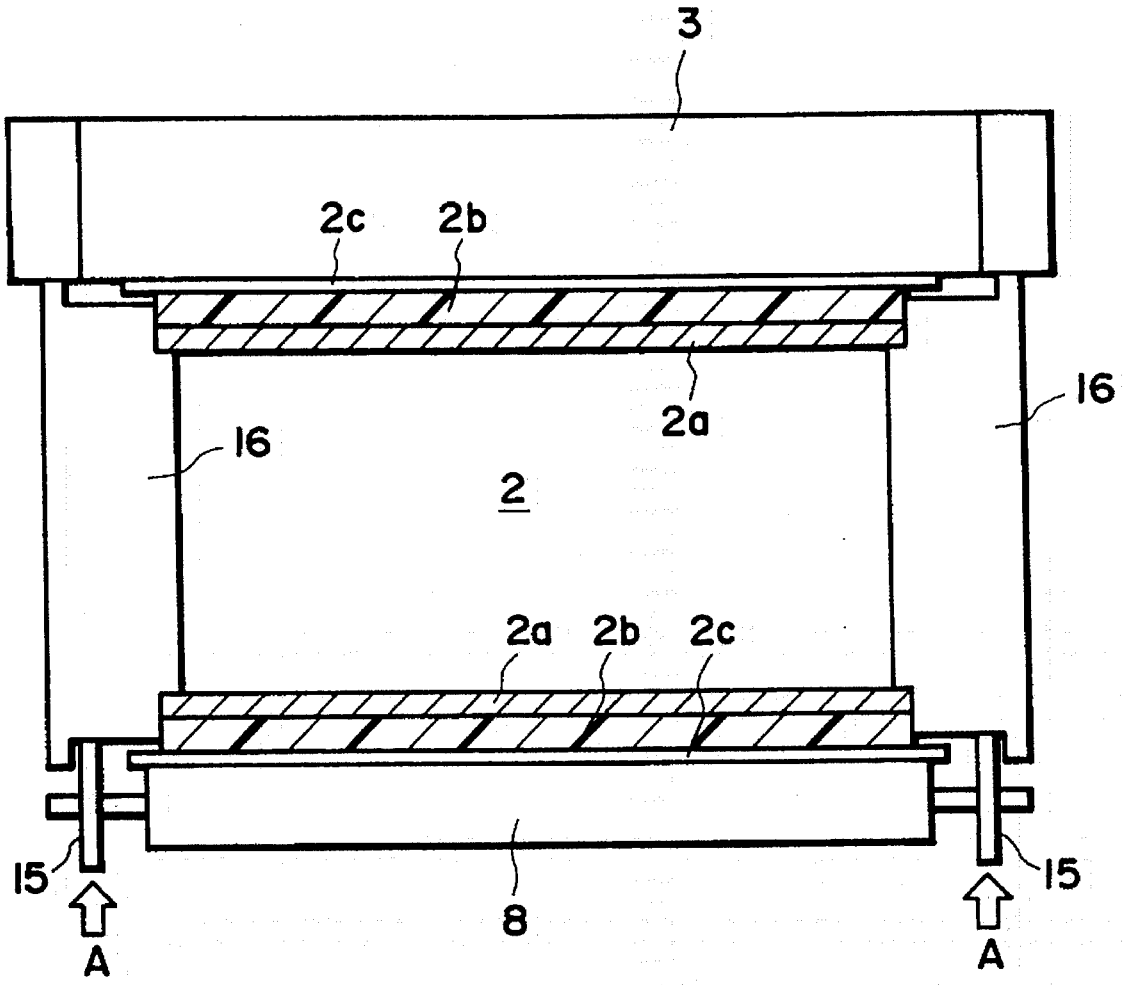
FIG. 8 is a cross-sectional view showing a transfer drum and an adsorbing roller when they are abutted each other.

Referring now to FIG. 1 which is a cross-sectional view showing the transfer drum 2 and the adsorbing roller 8 when the latter bears against the former, the transfer drum 2, as previously described, is of a basic construction comprising the metallic cylinder 2*a* serving also as a transfer electrode, the electrically conductive elastic material layer 2*b* fitted over the metallic cylinder 2*a*, and the dielectric material layer 2*c* covering the electrically conductive elastic material layer 2*b*. Specifically, an aluminum cylinder is used as the metallic cylinder the electrically conductive elastic material layer 2*b* is provided to a thickness of 5.7 mm thereon, and the dielectric material layer 2*c* is provided on the elastic layer 2*b* by a dielectric material sheet of a thickness of 100 μm. The outer diameter of the transfer drum 2 is 161.6 mm. Flanges 16 are provided on the opposite ends of the transfer drum 2, and the outer diameter of the outermost peripheral portion 16*a* provided on the end portion of each flange 16 for bearing against the photosensitive drum 3 of FIG. 8 is 160.0 mm. The outer diameter of the photosensitive drum 3 is 40 mm.

Figure 3:
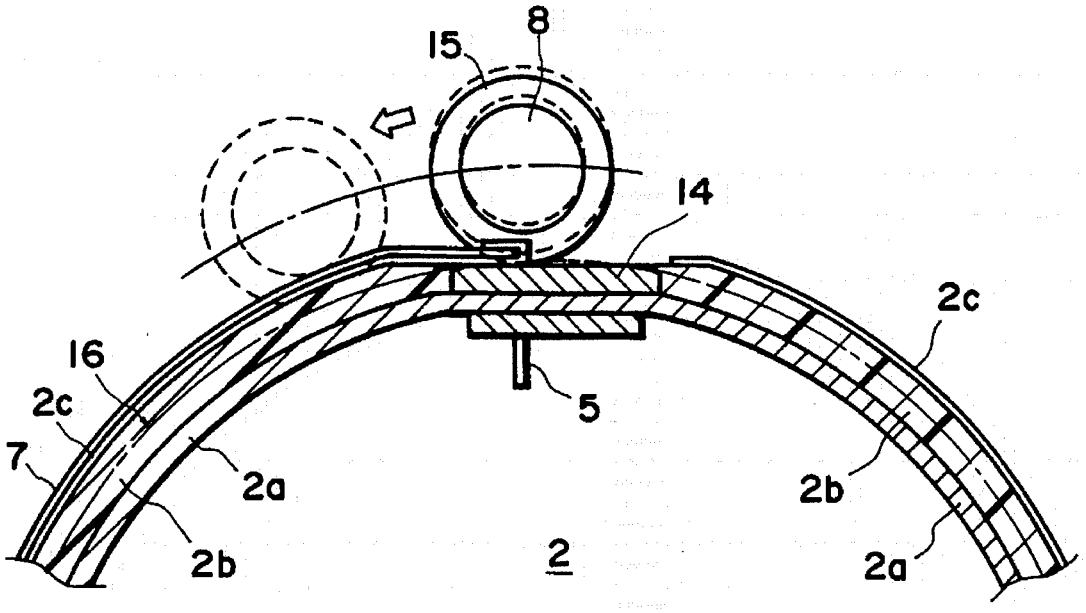
FIG. 3 is a cross-sectional view showing a state in which the adsorbing roller is going to abut against a transfer medium gripped by the gripper of the transfer drum.

As shown in FIG. 3, a recess extending in the direction of the rotary shaft of the transfer drum 2 is formed in a portion of the transfer drum 2 by cutting away the elastic layer 2*b* and the dielectric material layer 2*c*, and the grippers 5 which are transfer medium gripping members are provided in this recess with its tip end protruded.

As the electrically conductive elastic material layer 2*b*, use is made of foamed EPDM rubber of which the volume resistivity is about $10^5$ Ω.cm and the hardness is 40°–70 °in terms of Asker F hardness. As the elastic material layer 2*b*, use can be made of elastic sponge resin such as foamed urethane foam, foamed CR rubber or foamed silicone rubber, or rubber. Also, as the dielectric material sheet of the dielectric material layer 2*c*, use is made of a PVdF sheet of which the dielectric constant is of the order of 9–11 and the volume resistivity is $10^{14}$–$10^{16}$ Ω.cm. As the dielectric material sheet, use can be made of a resin sheet such as nylon, polycarbonate, PET, PEN or polyimid having its resistance suitably adjusted. It is preferable that the hardness of the elastic material layer 2*b* be low in order to prevent a void phenomenon during transfer.

With the above-described construction, when the transfer drum 2 was caused to abut against the photosensitive drum 3 with total pressure of 2–3 kg by a construction similar to that of FIG. 8, the radius of the transfer drum 2 which had been the radius a =80.8 nun during non-abutment was compressed to the radius 80.0 mm of the outermost peripheral portion 16*a* of the flange. That is, the elastic material layer 2*b* was compressed by 0.8 mm. At this time, the pressure force by the flexure in the portion of contact between the elastic material layer 2*b* and the photosensitive drum 3 was of the order of 500–1000 g in total.

An example of a mechanism for causing the adsorbing roller 8 provided with rollers 15 at the opposite ends thereof to bear against the transfer drum 2 and releasing the bearing will now be described with reference to FIG. 4.

The bearing and releasing mechanism has a holder member 20 provided with holders 22 at the opposite ends thereof, and electrically conductive bearing 21 and a pressing spring 23 supporting it are contained in each of the holders 22. The bearing 21 has its movement except in the direction of arrow C regulated by the holder 22. The adsorbing roller 8 is provided so as to be movable in the direction of arrow C by the pressing spring 23, by the shaft portion 8*a* of the adsorbing roller 8 being supported by the electrically conductive bearing 21. Also, the pressing spring 23 is mounted on an electrode plate 24 provided on the holder member 20, and an adsorbing bias voltage of the same polarity as the charge polarity of the toners can be applied to the adsorbing roller 8 between it and the cylinder 2*a* of the transfer drum 2 by a bias voltage source 25 connected through the electrode plate 24. The holder member 20 is engaged with a fixed member 27 provided in the image forming apparatus by a tension spring 26 and is movable in the direction of arrow B by the rotation of an eccentric cam 28 rotatably supported on the fixed member 27 and bearing against the holder member 20.

Figure 4:
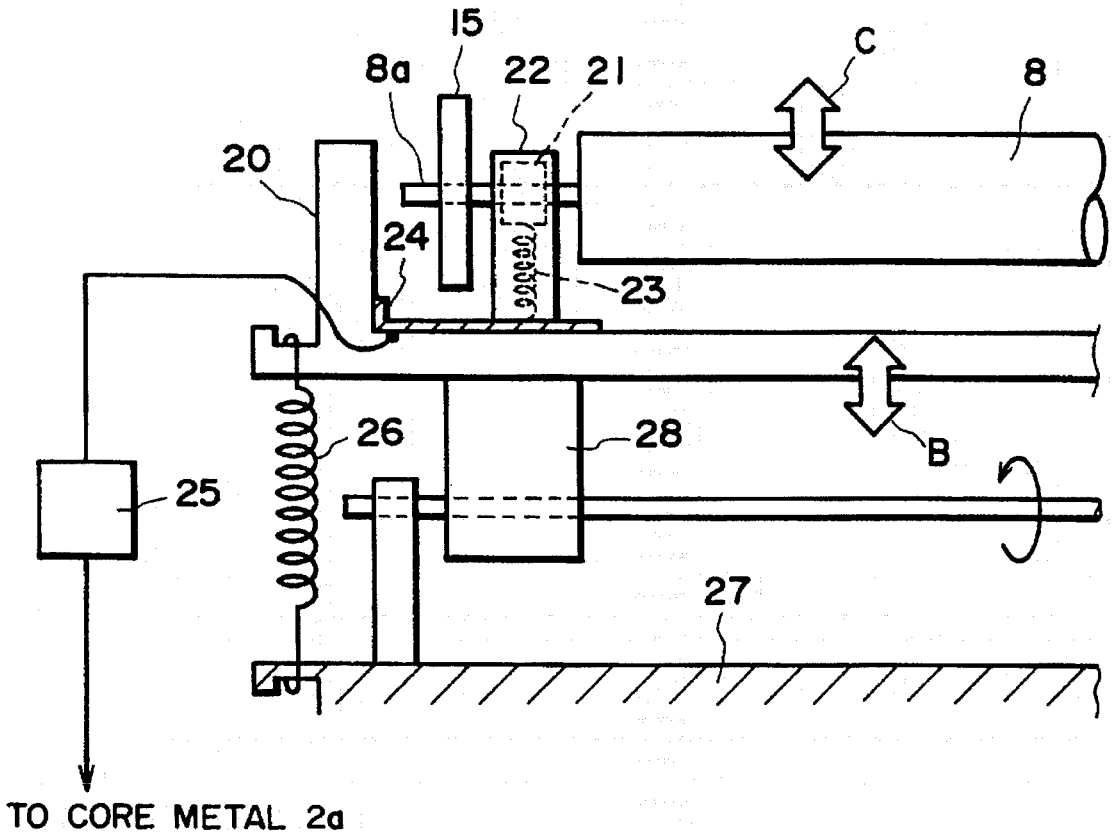
FIG. 4 is a cross-sectional view showing the construction of the essential portions of an example of a bearing and releasing mechanism for the adsorbing roller.

To cause the adsorbing roller 8 to abut against the transfer drum 2 of FIG. 1, the eccentric cam 28 can be half-rotated to thereby move the holder member 20 upwardly as viewed in FIG. 4, and the pressure force of the adsorbing roller 8 can be provided by the compression of the spring 23 and the adsorbing roller 8 can be moved toward the transfer drum 2. To release the adsorbing roller 8 bearing against the transfer drum 2, the eccentric cam 28 can be half-rotated from its position during the bearing and the holder 20 can be downwardly moved by the tension of the tension spring 26 to thereby release the pressure force of the adsorbing roller 8 provided by the compression of the spring 23, and the adsorbing roller 8 can be retracted from the transfer drum 2. The example shown in FIG. 4 is an example of the method of causing the adsorbing roller 8 to bear against the transfer drum and releasing the bearing, and other suitable method can also be used.

It is desirable from the viewpoint of the prevention of image vibration that the bearing operation by the above-described bearing and releasing mechanism be completed before the timing at which image formation is effected. Likewise, it is desirable that the releasing operation be effected and completed after the adsorption of the transfer medium and except during image formation, and for example, in a case where the transfer medium is supplied to the transfer drum 2 and the formation of the image of a first color is effected when the transfer medium 7 adsorbed to the transfer drum 2 first passes the transfer station, it is desirable that the releasing operation by the eccentric cam 28, etc. be completed immediately after the transfer of the image of a first color is terminated in the transfer station and before the formation of the image of a second color is started on the photosensitive drum 3.

However, to effect bearing and release in the desirable state described above, there occurs the inconvenience that the bearing operation must be entered before the grippers 5 of the transfer drum 2 or the support member 14 therefor comes to the opposed surface of the adsorbing roller 8 or even if the grippers 5 or the support member 14 again comes to the opposed surface of the adsorbing roller 8 after the trailing end of the transfer medium has passed, bearing becomes incapable of being released until the image forming process including the exposure, development, transfer, etc. of the trailing end of the image is terminated.

Turning back to FIG. 1, the construction of the adsorbing roller 8, etc. will now be described. In the present embodiment, for the adsorbing roller 8, use is made of CR rubber of which the volume resistivity is $10^3$ Ω.cm or less and the hardness is JIS-A 50°–70°. The rollers 15 are provided on the opposite ends of the adsorbing roller 8, as previously described. The radius b of the adsorbing roller 8 is 8.0 mm, the radius d of each roller 15 is 10.0 mm, and the radius c of the portion 16*b* which is opposed to the roller 15 except the outermost peripheral portion 16*a* of the end portion of the flange 16 is 77.5 mm.

With such a construction, when near the rollers 15, the adsorbing roller 8 was urged in the direction of arrow A in FIG. 1 (upwardly in the direction of arrow C in FIG. 4) with total pressure of 300 g by pressing means such as the spring 23 of the bearing and releasing mechanism of FIG. 4 to thereby cause the whole of the adsorbing roller 8 to bear against the transfer drum 2, the elastic material layer 2*b* of the transfer drum 2 was compressed by only about 0.3 mm in the direction of thickness thereof and the adsorbing roller 8 abutted against the outermost dielectric material layer 2*c* of the transfer drum 2. This bearing pressure may preferably be within the range of 50 to 500 g and can be obtained by adjusting the spring 23 used.

Accordingly, in FIG. 1, the distance e from the center of the shaft of the transfer drum 2 to the outer surface of the dielectric material layer 2*c* in the abutting portion of the transfer drum 2 against the adsorbing roller 8 is of the order of $$e=a-0.3=80.3-0.30=80.5 \text{ mm.}$$

Also, at this time, the portion 16*a* of the roller 15 which is opposed to the flange 16, as shown in FIG. 1, becomes opposed with a gap of the order of 1.00 mm, from $$\Delta t=b+e-c-d$$

$$=8.0+80.5-77.5-10.0$$

$$=1.0 \text{ mm.}$$

Further, at this time, the distance f between the shafts of the transfer drum 2 and the adsorbing roller 8 is of the order of $$f=c+d+\Delta t$$

$$=77.5+10.0+1.0$$

$$=88.5 \text{ mm.}$$

Figure 2:
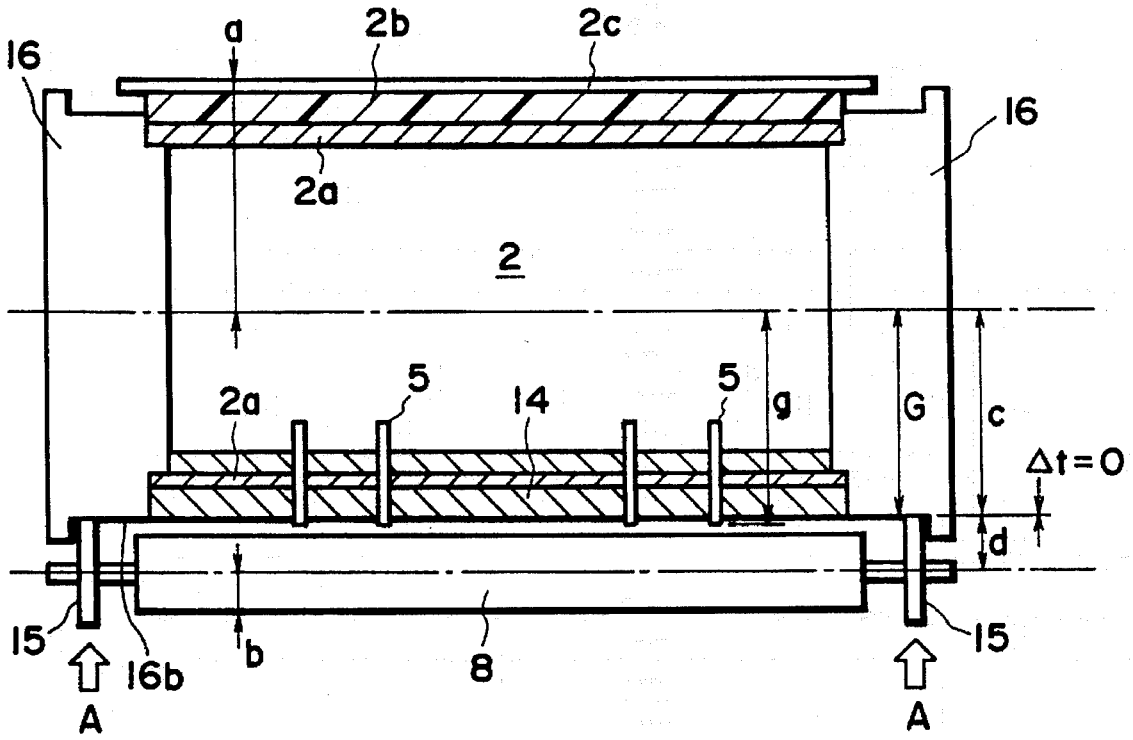
FIG. 2 is a cross-sectional view showing the transfer drum and the adsorbing roller when their abutment is avoided.

Next, when the transfer drum 2 is rotated after it is born against by the adsorbing roller 8 and the recess of the transfer drum 2 in which the gripper 5 and the support member 14 therefor are provided comes to the opposed portion of the adsorbing roller 8, the abutting state of the adsorbing roller 8 against the dielectric material layer 2*c* is once released and the recess of the transfer drum 2 becomes positioned on the opposed portion of the adsorbing roller 8. Instead, as shown in FIGS. 2 and 3, the rollers 15 abut against the portions 16*b* of the flanges 16 which are opposed to the rollers. That is, Δt=0. Here, the maximum height g of the grippers 5 from the center of the shaft of the transfer drum 2 is 76 mm, and when the distance from the center of the shaft of the transfer drum 2 to the outer surface of the opposed portion of the adsorbing roller 8 is G.

$$G=c+d-b$$

$$=77.5+10.0-8.0$$

$$=79.5 \text{ mm}$$

and therefore, the adsorbing roller 8 does not contact with the grippers 5.

When the rotation of the transfer drum 2 further progresses, the end surface of the transfer medium 7 gripped by the grippers 5 appears on the opposed surface of the adsorbing roller 8, as shown in FIG. 3 which shows the then movement of the adsorbing roller 8 relative to the transfer drum 2, and soon the adsorbing roller 8 begins to bear against the transfer medium 7 and rides onto the transfer medium 7, whereby the rollers 15 on the opposite ends of the adsorbing roller 8 gradually separate from the flanges 16 at the opposite ends of the transfer drum 2.

That is, if with regard to the radius a of the transfer drum 2 during non-abutment, the radius b of the adsorbing roller 8 during non-abutment, the distance f between the shafts of the transfer drum 2 and the adsorbing roller 8 during abutment with the elastic material layer **2*b*, etc. interposed therebetween, the radius d of the rollers 15, the radius c of the flanges 16 on the opposed surface of the rollers 15 and the maximum height g of the grippers 5 from the center of the shaft of the transfer drum 2**, a construction which satisfies the relation that $$(a+b)>f>(c+d)>(g+b) \quad (1)$$

is adopted, the rollers 15 will slightly move into contact with the flanges 16 when the grippers 5 and the support member 14 therefor come to the opposed surface of the adsorbing roller 8, and the rollers 15 will support the adsorbing roller 8 in a spaced-apart state without moving it toward the grippers 5 and thus, the contact of the adsorbing roller 8 with the grippers 5 can be avoided and no shock will arise when the grippers 5 pass the adsorbing roller 8.

Moreover, in the other portions than the grippers 5, the adsorbing roller 8 bears against the elastic material layer **2*b* with the dielectric material layer 2*c* of the transfer drum 2 interposed therebetween and the rigid rollers 15 and flanges 16 are not in pressure contact with each other, and this leads to the advantage that the vibration resulting from the rotation of the adsorbing roller 8 is hardly transmitted to the transfer drum 2**.

Further, when the surface of the adsorbing roller 8 is contaminated with the toners as during the occurrence of jam, the grippers 5 can be prevented from being contaminated. That is, adsorbing bias of the same polarity as that of the toners (i.e., the opposite polarity from transfer bias) (in the present embodiment, negative toners being used as the developers and the adsorbing bias being nearly −1 kV) is usually applied to the adsorbing roller 8 between it and the transfer drum and therefore, there may arise the problem that the toners are re-transferred to the members in contact with the adsorbing roller and contaminate them. According to the present invention, however, the adsorbing roller 8 does not contact with the grippers and therefore, the adherence of the toners to the grippers 5 and the contamination thereof can be prevented. Of course, the adsorbing bias does not leak out through the grippers 5, etc. because the adsorbing roller 8 does not contact with the grippers 5, etc.

In the foregoing, in order to prevent the bias voltage from leaking in the end portions of the adsorbing roller 8, it is preferable that in addition to the aforementioned expression (1) the following expression (2) be satisfied. Further, in order to maintain the amount of nip constant and obtain a sufficient adsorbing force in the end portions of the adsorbing roller 8, it is preferable that the following expression (3) be also satisfied.

When in FIG. 1, the width of the electrically conductive elastic material layer **2*b* is $w_2$ and the width of the dielectric material layer 2*c* is $w_1$ and the width of the adsorbing roller 8** is $w_3$, $$w_3<w_1 \quad (2)$$

and $$w_2<w_3. \quad (3)$$

According to the present embodiment, the adsorbing roller 8 is urged against the dielectric material layer **2*c* of the transfer drum 2 by the spring 23 and therefore, the adsorbing roller 8 bears against the dielectric material layer 2*c* with predetermined pressure even if the outer diameters of the transfer drum 2 and the adsorbing roller 8 have irregularity. As a result, the balance of the contact between the photosensitive drum 3 and the transfer drum 2 and between the transfer drum 2 and the adsorbing roller 8 can be kept good and it becomes possible to form a color image free of misregistration. Also, during adsorption, the transfer medium 7 can be prevented from being pushed by the adsorbing roller 8** with excessively great pressure and deformed more than necessary.

This deformation is of a curvature opposite to that when the transfer medium 7 twines around the transfer drum 2 (because the diameter of the adsorbing roller 8 is small and the adsorbing roller 8 is harder than the elastic material layer **2*b* of the transfer drum 2) and therefore, a strain in a direction to strip off the transfer drum 2 the transfer medium 7** adsorbed thereto is imparted to the transfer medium with a result that the adsorbing force is weakened, and this is not preferable. As previously described, however, fin the present embodiment, the bearing pressure can be controlled within a proper range of 50–500 g (in the present embodiment, 300 g) and the adsorbing property is not spoiled.

Further, when the grippers 5 provided in the recess of the transfer drum 2 and the adsorbing roller 8 become opposed to each other, the adsorbing roller 8 can be accurately spaced apart from the grippers with a slight amount of stroke.

Description will now be made of another embodiment which is applicable to the image forming apparatus of the previous embodiment. This embodiment shows a case where the present invention is applied to a charge removing roller for the transfer drum.

Figure 5:
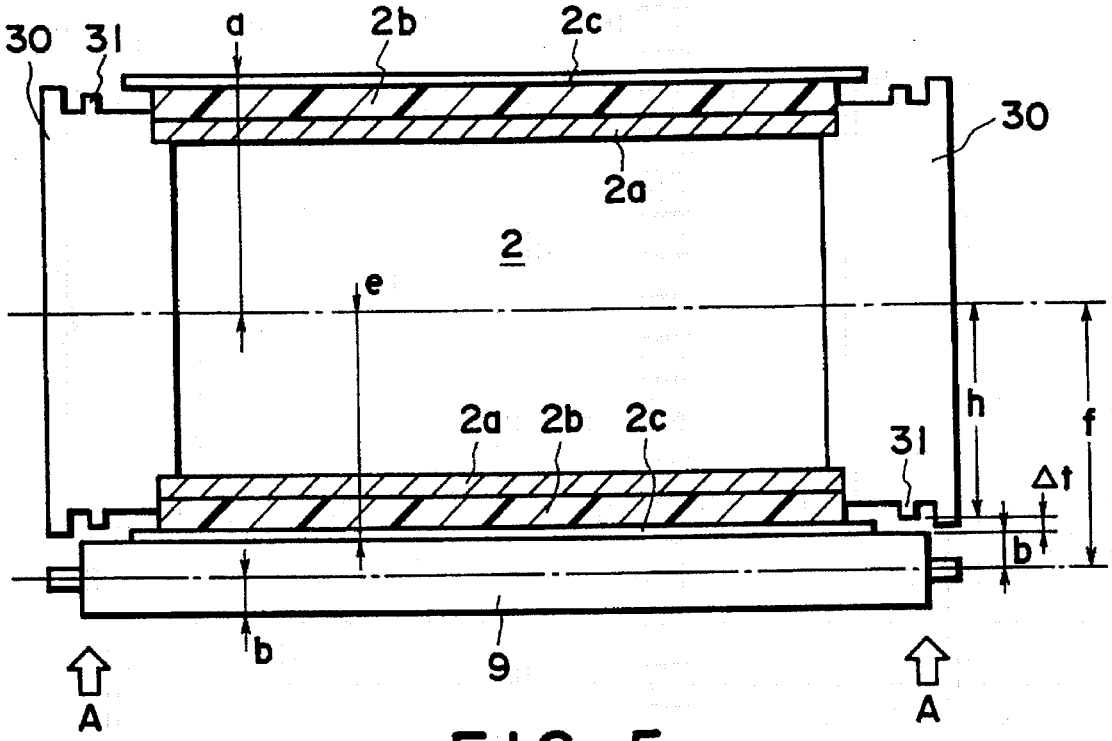
FIG. 5 is a cross-sectional view showing a transfer drum and a charge removing roller in another embodiment of the present invention when they are abutted each other.
Figure 6:
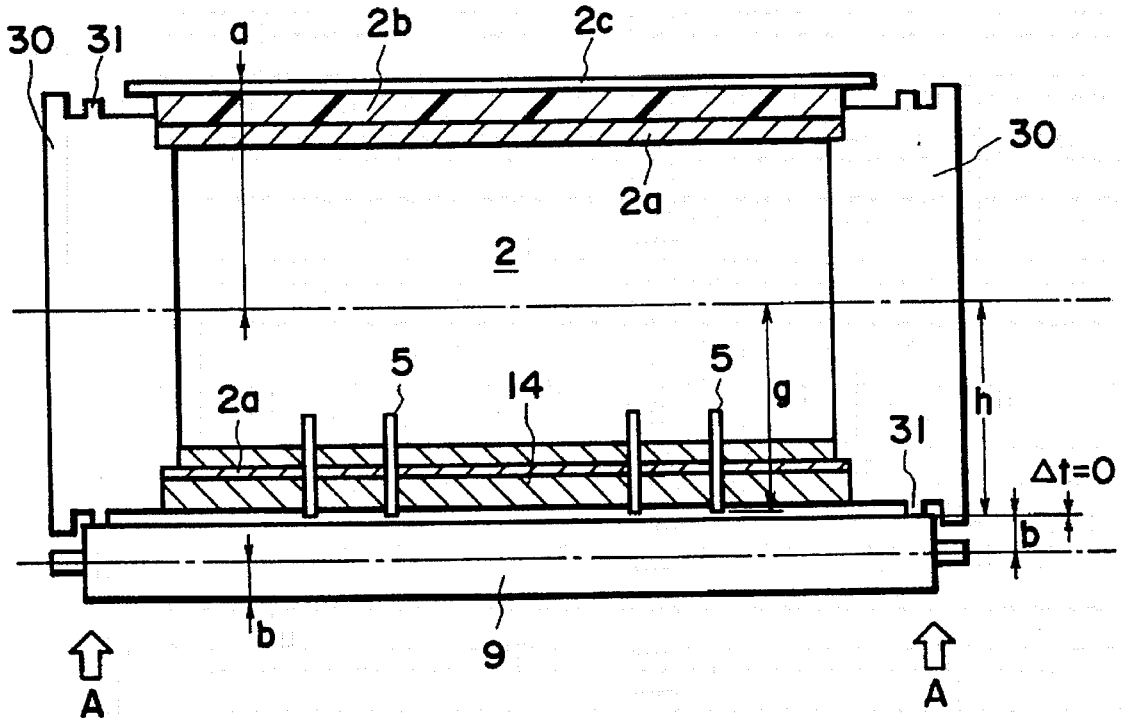
FIG. 6 is a cross-sectional view showing the transfer drum and the charge removing roller in another embodiment when their abutment is avoided.

FIG. 5 is a cross-sectional view showing the transfer drum and the charge removing drum in the present embodiment when the latter abuts against the former, and FIG. 6 is a cross-sectional view showing the transfer drum and the charge removing roller when the abutment is avoided. In the present embodiment, it is a great feature that distance regulating rollers are eliminated at the opposite ends of the charge removing rollers 9, and instead, gap regulating portions 31 are provided at locations near the opposite ends of the charge removing roller 9 on flanges 30 at the opposite ends of the transfer drum 2.

While the adsorbing roller 8 in the previous embodiment uses a rubber material to improve the keeping of the transfer medium 7, the charge removing roller 9 in the present embodiment is directed to directly abut against the transfer drum 2 without a transfer medium being interposed therebetween and remove the surface charges thereof and therefore, a rigid metallic roller can be used as the charge removing roller 9. Particularly when with the supply of transfer mediums, the surface of the charge removing roller 9 is contaminated with paper powder or the like and assumes high resistance, it will be good to use a rigid metallic roller instead of a rubber roller and mount paper powder removing means such as a scraper on it.

In such case, the magnitude of the shock when the charge removing roller 9 bears against the transfer drum is determined by the hardness of the elastic material layer **2*b* of the transfer drum 2, but there will be no problem if use is made of an elastic material of Asker F hardness 40° to 80° as described in the previous embodiment. If the charge removing roller 9** is thus formed of a rigid material, it will be possible to eliminate the rollers at the opposite end, as previously described.

When the radius of the gap regulating portions 31 of the flanges 30 is h, expression (1') corresponding to expression (1) mentioned in the previous embodiment or expression (4) obtained by modifying it is satisfied, whereby the rigid charge removing roller 9 can avoid its contact with the grippers 5 and any shock or the like resulting from this avoiding movement can also be prevented in the same manner as in the previous embodiment. That is, when the radius of the transfer drum 2 during non-abutment is a and the radius of the charge removing roller 9 is b and the distance between the shafts of the transfer drum 2 and charge removing roller 9 during abutting with the elastic material layer **2*b*, etc. interposed therebetween is f and the maximum height of the grippers 5 from the center of the shaft of the transfer drum 2 is g and the radius of the gap regulating portions 31 of the flanges 30** is h, $$(a+b)>f>(b+h)+(b+g) \quad (1')$$

because the charge removing roller 9 is a rigid member, and further, expression (1') can be modified into the following expression (4):

$$a>(f-b)>h>g \quad (4)$$

In the present embodiment, as described above, the gap regulating portions are provided on portions of the flanges 30 of the transfer drum 2 and therefore, distance regulating rollers can be eliminated at the opposite ends of the charge removing roller 9 to thereby simplify the construction.

While the case of the charge removing roller 9 has been shown above, the present invention is not restricted thereto, but the system of the charge removing roller can also be applied to the adsorbing roller. Likewise, the system of the adsorbing roller 8 shown in the previous embodiment can be applied to the charge removing roller 9.

In any of the above-described embodiment, there has been shown an example in which the elastic material layer **2*b* of the transfer drum 2 is made electrically conductive and this layer is covered with the dielectric material layer 2*c* provided by a dielectric material sheet, but alternatively, use can be made of a dielectric material sheet having its back subjected to an electrical conducting process such as metal deposition by evaporation or application of electrically conductive paint. In this case, an insulative elastic material instead of an electrically conductive elastic material may be used for the elastic material layer 2*b*** and the electrical conductivity treated portion may be directly conducted to the bias voltage source by an electrode or the like. Of course, the effectiveness of the present invention would be changed in no way by such a modification.

What is claimed is:

1. An image forming apparatus, comprising:

a recording medium bearing member carrying a recording medium thereon and rotatable, said recording medium bearing member having in the surface thereof a recess extending in the direction of the rotary shaft thereof, image formation being effected on the recording medium born on said recording medium bearing member; and a rotatable member abutting against said recording medium bearing member, said rotatable member being provided with a abutting portion abutting against said recording medium bearing member, and a regulating portion adapted to abut against said recording medium bearing member when said recess and said rotatable member become opposed to each other, thereby regulating the distance between said recess and said abutting portion, said rotatable member being movable between a first position in which said abutting portion abuts against said recording medium bearing member and a second position in which said regulating portion abuts against said recording medium bearing member;

said regulating portion being spaced apart from said recording medium bearing member when said abutting portion is abutted against said recording medium bearing member.

2. An image forming apparatus according to claim 1, satisfying the following condition:

$$(A+B)>F>(C+D)>(G+B),$$

where A is the radius of that area of said recording medium bearing member which is abutted against by said abutting portion when said recording medium bearing member and said abutting portion are spaced apart from each other, B is the radius of said abutting portion when said recording medium bearing member and said abutting portion are spaced from each other, C is the radius of that area of said recording medium bearing member which is abutted against by said regulating portion, D is the radius of said regulating portion, F is the distance between the rotary shaft of said recording medium bearing member and the rotary shaft of said rotatable member when said abutting portion abuts against said recording medium bearing member, and G is the maximum distance in said recess from the rotary shaft of said recording medium bearing member.

3. An image forming apparatus according to claim 2, wherein said rotatable member is movable to a third position in which it does not abut against said recording medium bearing member.

4. An image forming apparatus according to claim 2, wherein a gripping member for gripping the leading end of the recording medium is provided in said recess.

5. An image forming apparatus according to claim 4, wherein said value G is the distance from the rotary shaft of said recording medium bearing member to the remotest end portion of said gripping member in a state in which said gripping member grips the leading end portion of the recording medium.

6. An image forming apparatus according to claim 1 or 2, wherein said rotatable member is urged against said recording medium bearing member by a resilient member irrespective or said first and second positions.

7. An image forming apparatus according to claim 6, wherein said recording medium bearing member is provided with a dielectric material layer bearing the recording medium thereon, and an elastic layer provided on that side of said dielectric material layer which is opposite to the recording medium bearing surface thereof.

8. An image forming apparatus according to claim 7, further having an image bearing member bearing an image thereon and wherein a voltage is applied to said dielectric material layer to transfer the image on said image bearing member to the recording medium born on said dielectric material layer.

9. An image forming apparatus according to claim 8, wherein said image bearing member bears a plurality of images successively thereon, and the images on said image bearing member are successively superposed and transferred to the recording medium born on said dielectric material layer.

10. An image forming apparatus according to claim 8, satisfying the following condition:

$$w_2<w_3,$$

where $W_2$ is the width of said elastic layer to which a voltage is applied in the direction of the rotary shaft of said recording medium bearing member, and $W_3$ is the width of said abutting portion in the direction of the rotary shaft of said rotatable member.

11. An image forming apparatus according to claim 8, satisfying the following condition:

$$W_3<W_1,$$

where $w_1$ is the width of said dielectric material layer in the direction of the rotary shaft of said recording medium bearing member, and $w_3$ is the width of said abutting portion in the direction of the rotary shaft of said rotatable member.

12. An image forming apparatus according to claim 1 or 2, wherein said rotatable is an adsorbing roller for imparting charges to said recording medium bearing member to adsorb the recording medium to said recording medium bearing member.

13. An image forming apparatus according to claim 1 or 2, wherein said rotatable member is a charge removing roller for removing charges from said recording medium bearing member.

14. An image forming apparatus according to claim 1 or 2, wherein said regulating portion is a roller provided on the rotary shaft of said rotatable member.

15. An image forming apparatus having:

a recording medium bearing member bearing a recording medium thereon and rotatable, said recording medium bearing member having in the surface thereof a recess extending in the direction of the rotary axis thereof, image formation being effected on the recording medium born on said recording medium bearing member; and a rotatable member movable toward and away from said recording medium bearing member, said rotatable member being provided with an abutting portion adapted to abut against said recording medium bearing member, said rotatable member being movable between a first position in which said abutting portion abuts against said recording medium bearing member and a second position in which said abutting portion is spaced apart from said recess;

said recording medium bearing member being provided with a regulating portion adapted to abut against said rotatable member when said recess and said rotatable member become opposed to each other, thereby regulating the distance between said recess and said abutting portion, said regulating portion being spaced apart from said rotatable member when said abutting portion is abutting against said recording medium bearing member.

16. An image forming apparatus according to claim 15, satisfying the following condition:

$$A>E>H>G,$$

where A is the radius of that area of said recording medium bearing member which is abutted against by said abutting portion when said recording medium bearing member and said abutting portion are spaced apart from each other, E is the radius of that area of said recording medium bearing member which is abutted against by said abutting portion when said abutting portion is abutting against said recording medium bearing member, H is the radius of said regulating portion, and G is the maximum distance in said recess from the rotary shaft of said recording medium bearing member.

17. An image forming apparatus according to claim 16, wherein said rotatable member is movable to a third position in which it does not abut against said recording medium bearing member.

18. An image forming apparatus according to claim 16, wherein a gripping member for gripping the leading end of the recording medium is provided in said recess.

19. An image forming apparatus according to claim 18, wherein said value G is the distance from the rotary shaft of said recording medium bearing member to the remotest end portion of said gripping member in a state in which said gripping member grips the leading end portion of the recording medium.

20. An image forming apparatus according to claim 15 or 16, wherein said rotatable member is urged against said recording medium bearing member by a resilient member irrespective of said first and second positions.

21. An image forming apparatus according to claim 20, wherein said recording medium bearing member is provided with a dielectric material layer bearing the recording medium thereon, and an elastic layer provided on that side of said dielectric material layer which is opposite to the recording medium bearing surface thereof.

22. An image forming apparatus according to claim 21, further having an image bearing member bearing an image thereon and wherein a voltage is applied to said dielectric material layer to transfer the image on said image bearing member to the recording medium born on said dielectric material layer.

23. An image forming apparatus according to claim 2, wherein said image bearing member bears a plurality of images successively thereon, and the images on said image bearing member are successively superposed and transferred to the recording medium born on said dielectric material layer.

24. An image forming apparatus according to claim. 22, satisfying the following condition:

$$w_2<w_3,$$

where $w_2$ is the width of said elastic layer to which a voltage is applied in the direction of the rotary shaft of said recording medium bearing member, and $w_3$ is the width of said abutting portion in the direction of the rotary shaft of said rotatable member.

25. An image forming apparatus according to claim 22 satisfying the following condition:

$$w_3<w_1,$$

where $w_1$ is the width of said dielectric material layer in the direction of the rotary shaft of said recording medium bearing member, and $w_3$ is the width of said abutting portion in the direction of the rotary shaft of said rotatable member.

26. An image forming apparatus according to claim 15 or 16, wherein said rotatable member is an adsorbing roller for imparting charges to said recording medium bearing member to adsorb the recording medium to said recording medium bearing member.

27. An image forming apparatus according to claim 15 or 16, wherein said rotatable member is a charge removing roller for removing charges from said recording medium bearing member.

28. An image forming apparatus according to claim 15 or 16, wherein said regulating portion is a roller provided on the rotary shaft of said rotatable member.

* * * * *

UNITED STATES PATENT AND TRADEMARK OFFICE

CERTIFICATE OF CORRECTION

PATENT NO. : 5,715,506

DATED : February 3, 1998

INVENTOR(S) : Akihiko TAKEUCHI, et al.

It is certified that error appears in the above-indentified patent and that said Letters Patent is hereby corrected as shown below:

Column 3, line 24, after "drum", insert --2--.

Column 4, line 56, delete "nun" and insert therefor --mm--.

Column 8, line 28, delete "fin" and insert therefor --in--.

Column 10, line 52, delete "or" and insert therefor --of--.

Column 11, line 23, after "rotatable", insert --member--.

Column 12,

Line 44, after "claim", delete the period (".");

Line 54, after "22, insert a comma (",").

UNITED STATES PATENT AND TRADEMARK OFFICE

CERTIFICATE OF CORRECTION

PATENT NO. : 5,715,506
DATED : February 3, 1998
INVENTOR(S) : Akihiko TAKEUCHI, et al.

It is certified that error appears in the above-identified patent and that said Letters Patent is hereby corrected as shown below:

Column 12, line 38, delete "2" and insert therefor --22--.

Signed and Sealed this

Thirteenth Day of October 1998

*Attest:*

*Attesting Officer*

BRUCE LEHMAN

*Commissioner of Patents and Trademarks*